United States Patent [19]

Petersen

[11] Patent Number: 4,644,747

[45] Date of Patent: Feb. 24, 1987

[54] LOW-STRESS SHIELDED EXHAUST PASSAGE ASSEMBLIES

[75] Inventor: Donald R. Petersen, Livonia, Mich.

[73] Assignee: General Motors Corporation, Detroit, Mich.

[21] Appl. No.: 827,531

[22] Filed: Feb. 10, 1986

[51] Int. Cl.[4] ..... F01N 7/10

[52] U.S. Cl. ..... 60/322; 60/323; 285/261

[58] Field of Search ..... 60/282, 302, 322, 323; 285/187, 261, 302

[56] References Cited

U.S. PATENT DOCUMENTS

| | | | |
|---|---|---|---|
| 3,703,083 | 11/1972 | Tadokoro | 60/322 |
| 3,775,979 | 12/1973 | Scheitlin et al. | 60/322 |
| 3,939,897 | 2/1976 | Kaneko et al. | 164/103 |
| 4,168,610 | 9/1979 | Engguist | 60/322 |
| 4,288,988 | 10/1981 | Curtil . | |
| 4,468,925 | 9/1984 | Kersting . | |
| 4,553,775 | 11/1985 | Halling | 285/261 |

FOREIGN PATENT DOCUMENTS

| | | | |
|---|---|---|---|
| 2083154 | 3/1982 | United Kingdom | 285/187 |

*Primary Examiner*—Douglas Hart
*Attorney, Agent, or Firm*—Robert J. Outland

[57] ABSTRACT

An exhaust manifold, cylinder head, or the like, is provided with one or more insulating shield members formed within associated housing members having ball or cylindrical end portions. The end portions are seated on bearing rings preferably cast or inserted into the housing ends to provide for relative expansion of the internal shields with respect to the outer housing members, both linear and bending expansion motions being accommodated. The resulting passage assemblies may be formed by casting the housing members around their respective shields. Sand core material may be preapplied to create the desired insulating clearance between the associated members and, if desired, to secure the bearing rings in position.

8 Claims, 6 Drawing Figures

LOW-STRESS SHIELDED EXHAUST PASSAGE ASSEMBLIES

FIELD

This invention relates to shielded exhaust passage assemblies, such as engine exhaust manifolds, cylinder heads and the like. In particular, the invention relates to low-stress shielded exhaust passage assemblies and methods for their construction.

BACKGROUND

It is known in the art relating to internal combustion engines and the like to provide shields, or inner passage defining members, in exhaust passage means such as cylinder head exhaust ports, exhaust manifolds and the like. Various types of shields, or inner linings, have been provided for different purposes. One purpose has been to insulate the exhaust passages to reduce the outer skin temperature. Another has been to reduce the loss of engine exhaust heat prior to delivery to another device such as an exhaust turbocharger for using the high temperature exhaust energy or an exhaust treatment device such as a catalytic converter for supporting combustion reactions in the exhaust gases.

Depending upon the construction of and materials used in such shielded exhaust passage assemblies, the temperature changes occurring in the exhaust systems may result in severe stresses due to differential expansion of various portions of the inner shield members and the outer housing members. However, slip joints and other devices have been previously used to accommodate such stresses.

INVENTION SUMMARY

The present invention provides improved forms of low-stress shielded exhaust system assemblies for engine exhaust manifolds, cylinder heads and equivalent devices. Novel internal shield arrangements having slip jointed end connections with the housing members of their respective assemblies are utilized to provide low cost, low-stress shielded exhaust passage assemblies capable of manufacture by currently available techniques.

These and other features and advantages of the invention will be more fully understood from the following description of selected embodiments taken together with the accompanying drawings.

DRAWINGS

DESCRIPTION

Figure 1:
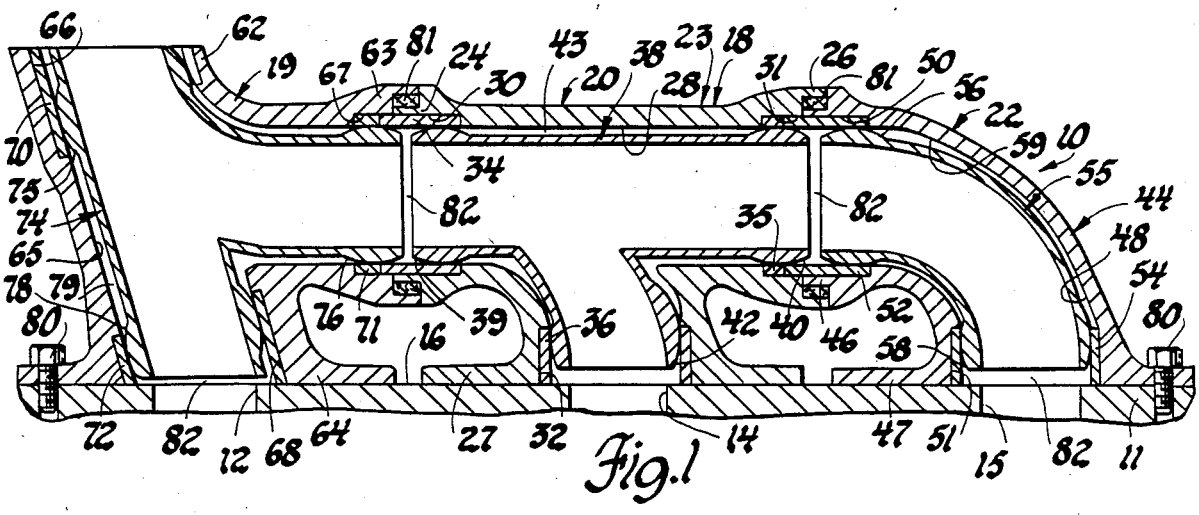
FIG. 1 is a cross-sectional view of an engine having a modular exhaust manifold made up of low-stress shielded exhaust system assemblies formed in accordance with the invention.

In the drawings, numeral 10 generally indicates an internal combustion engine having a cylinder head 11 including a plurality of axially aligned exhaust ports 12, 14, 15 opening through an outer wall 16 of the cylinder head. Secured to this outer wall 16 is a modular exhaust manifold 18 made up of low-stress shielded exhaust passage assemblies. These assemblies include an outlet passage assembly 19, a center passage assembly 20 and an inlet passage assembly 22, all formed in accordance with the invention and shown individually in FIGS. 2, 3 and 4.

Figure 2:
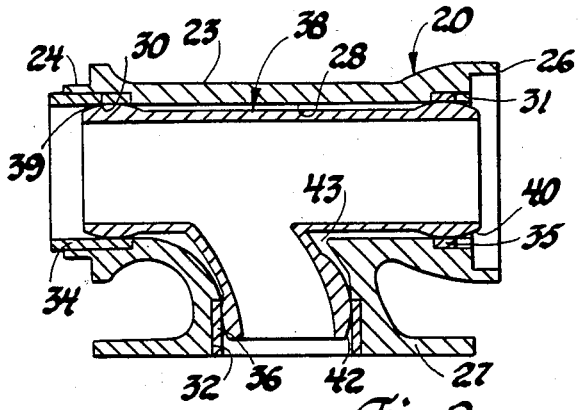
FIG. 2 is a cross-sectional view of the center assembly of the manifold of FIG. 1.
Figure 3:
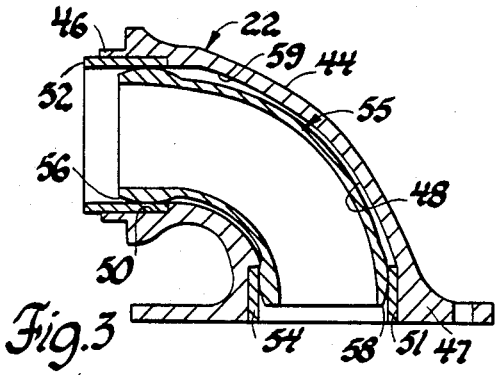
FIG. 3 is a cross-sectional view of the inlet end assembly of the manifold of FIG. 1.

The center passage assembly 20, shown in FIG. 2, preferably includes a cast housing having male and female connecting ends 24, 26, respectively, and a flanged inlet end 27, all interconnected by an internal cavity 28. At the housing ends in the cavity there are internal cylindrical counterbores 30, 31, 32 in which are disposed associated bearing rings 34, 35, 36 respectively. For purposes to be subsequently made clear, the ring 34 at the male end protrudes beyond the counterbore 30, the ring 35 at the female end is recessed from the end of the counterbore 31 and the ring 36 at the flanged inlet end extends flush with the end of the counterbore 32.

Within the cavity 28 and seated on the bearing rings 34–36, there is a tubular internal passage defining shield 38. This shield is essentially coextensive with the cavity 28 and includes three associated ball ends 39, 40, 42 seated respectively on the bearing rings 34, 35, 36.

Intermediate the ball ends, the exterior of the shield 38 is of slightly reduced diameter so as to provide a clearance 43 between the exterior of the shield 38 and the interior of the cavity 28. The clearance 43 is of any suitable dimension and is preferably selected to provide an optimum thickness heat insulating dead air space to minimize the transfer of heat from the passage defined by the interior of the shield 38 to the housing which internally defines the cavity 28.

The inlet and outlet end passage assemblies 22, 19, respectively, are constructed in fashion similar to that of the center passage assembly 20 just described. Accordingly, description of these assemblies will avoid repetition of similar detail and concentrate upon the differences in the constructions.

The inlet passage assembly 22 includes a housing 44 which has a male connecting end 46, a flanged inlet end 47 and internally defines a curved cavity 48. Counterbores 50, 51 at the ends are respectively provided with inserted cylindrical bearing rings 52, 54 which respectively protrude and are flush with the ends of their respective counterbores. An internal shield 55, having outlet and inlet ball ends 56, 58 seated on the bearing rings 52, 54, respectively, also includes a reduced diameter intermediate portion forming a clearance 59 between the inner cavity defining wall of the housing 44 and the outer surface of the shield 55.

Figure 4:
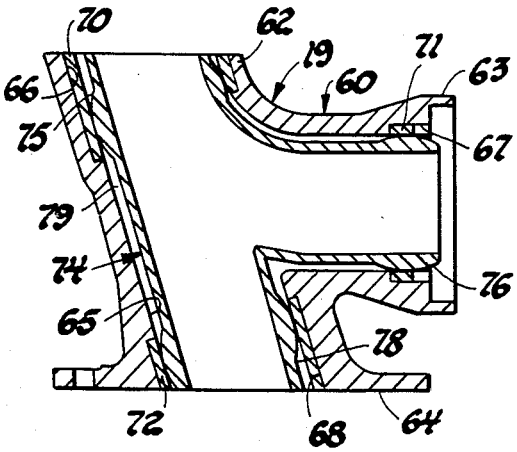
FIG. 4 is a cross-sectional view of the outlet end assembly of the manifold of FIG. 1.

In similar fashion, the outlet end passage assembly 19, shown in FIG. 4, includes a housing 60 having an outlet end 62, a female connecting end 63 and an inlet end 64. Counterbores 66, 67, 68 in the ends are provided with bearing rings 70, 71, 72 respectively which are flush with or, in the case of ring 71, recessed in their counterbores. A shield 74 within the cavity has ball ends 75, 76, 78 seated on the bearing rings 70, 71, 72 respectively. A reduced diameter portion intermediate the ball ends defines an insulating clearance 79 between the shield and the inner wall of the cavity 65.

In installation of the manifold on an engine, the individual passage assemblies 19, 20 and 22 are secured to the cylinder head 11 with their inlet passages aligned with the respective exhaust ports 12, 13, 15. Bolts 80, or the like, extend through the flanges of the flanged inlet ends 27, 47, 64, to retain the assemblies 19, 20, 22 against the outer wall 16 of the head 11.

During installation, the individual assemblies are interconnected, the male connecting ends 24, 46 of assemblies 20, 22 being inserted within the female connecting ends 63, 26 of assemblies 19 and 20, respectively. Also, the protruding portions of bearing rings 34, 52 extend into the spaces left by the recessed bearing rings 71, 35 to aid in properly aligning the internal passages defined by the interconnected assemblies and their inner shields 74, 38, 55. Preferably, high temperature seals 81 are installed in annular gaps between the male and female housing ends to prevent external leakage of exhaust gases through these expansion joints.

As assembled, the separate housing elements making up the exhaust manifold are permitted some relative motion due to the expansion joints between them which are sealed by the seals 81. In addition, the separate shield members 74, 38, 55 within the housing are free to expand or contract relative to their housings with free movement being permitted by sliding motion of the ball ends on their respective bearing rings.

Figure 5:
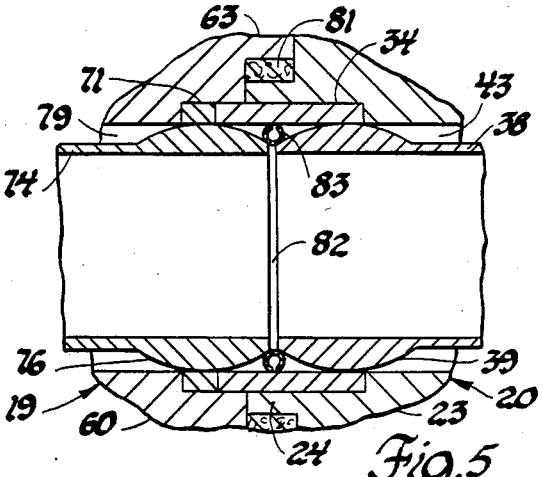
FIG. 5 is a cross-sectional view showing an optional arrangement for sealing the gaps between the ends of the shields of adjacent manifold sections.

Gaps 82 are provided between adjacent ends of the shields and between the inlet ends of the shields and the adjacent wall 16 of the cylinder head to provide freedom for longitudinal expansion of the inner shields without engaging one another or the cylinder head wall. If desired, these gaps may be closed by suitable high temperature seal members. As an example, FIG. 5 illustrates a connecting joint between passage assemblies 19 and 20 with a seal in the form of a spring steel ring 83 added.

Figure 6:
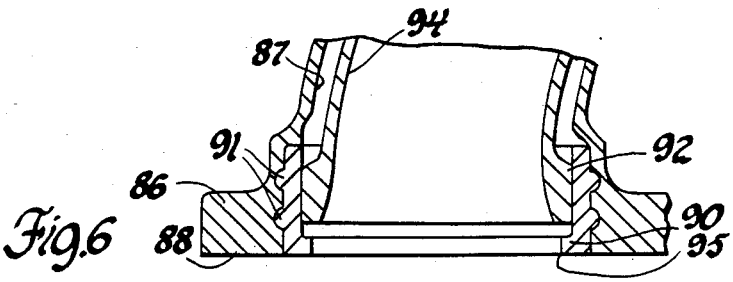
FIG. 6 is a cross-sectional view showing an optional form of shield mounting arrangement in an exhaust system assembly.

Various alternative embodiments of the bearing rings and connecting end portions of the shield members may be provided as indicated, for example, in FIG. 6 wherein an alternative embodiment of passage assembly is illustrated. In this embodiment, numeral 86 represents a housing, such as an engine cylinder head, defining an exhaust port 87 opening to an outer wall 88. A bearing ring 90 is mechanically locked by projections 91 into an annular recess at the outer end of the exhaust port and receives a cylindrical end 92 of a shield 94 disposed within the exhaust port 87. A radial lip 95 on the bearing ring prevents the shield 94 from sliding out of the port while allowing room for relative expansion of the shield with respect to the cylinder head housing 86.

A cylindrical end 92 may be utilized instead of a ball end at locations where it is expected that longitudinal motion of the associated parts will be sufficient to accommodate relative expansion and substantial bending or other expansion effects will not be encountered.

The construction of an exhaust manifold, cylinder head or other passage assembly having the features of the invention so far disclosed may be accomplished in any suitable manner.

A preferred method of making embodiments of the invention as specifically heretofore disclosed is to first form the shield members, such as by casting and, if necessary, machining the ball or cylindrical ends. Thereafter, the individual shield members are encapsulated within sand core material formed with a thickness about the shield members equal to the clearance desired between the shield and the outer housing. At this time the bearing rings may also be placed in position on the ball ends and sand core material packed in to fill any gaps desired to be left between the end portions of the shields and the bearing rings.

Subsequently, the prepared inserts are placed in molds and the outer housings of the passage assemblies are cast thereabout using cast iron, steel, aluminum or other suitable material.

Finally, the cast assemblies are removed from their molds and cleaned, the core sand being removed from the insulating spaces inside the housings and surrounding the shields. If desired, such sand removal may be accommodated by providing in the ball ends, or in the bearing inserts, longitudinal grooves or spaces, not shown. Final machining of the ends of the housings and bearing rings to properly fit with one another or their associated elements may then be accomplished and the assemblies are thus ready for installation on an engine or the like.

It should be understood that numerous changes or modifications of the concepts disclosed herein could be provided, if desired. For example, the housing members could be provided with flanges, not shown, at their associated male and female connecting ends. The flanges could then be bolted together so that a complete manifold assembly would be provided for installation on an engine as one unit rather than a series of separate assemblies. Such an arrangement would eliminate the relative expansion provision for the separate housing units but would permit relative expansion of the internal shield elements in the same manner as previously described.

While the invention has thus been described by reference to certain specific embodiments chosen for purposes of illustration, it is intended that the invention not be limited solely to the described embodiments but that it have the full scope permitted by the language of the following claims.

The embodiments of the invention in which an exclusive property or privilege is claimed are defined as follows:

1. A low-stress exhaust passage assembly for an internal combustion engine, said assembly comprising a housing defining a passage for the transmission of engine exhaust gases therethrough, the passage having at least two spaced ends opening outwardly of the housing, internal bearing means in the housing at each of said ends, at least one of the bearing means being of at least part-cylindrical form, and a tubular shield within the passage and extending between said spaced ends, said shield having ball-like ends, one engaging each of the bearing means to fix the lateral position of the shield within the passage, said ball-like shield ends providing slip joints within their associated bearing means to allow freedom for rotational motion, and said at least part-cylindrical bearing means also permitting free axial motion of its associated ball-like end.

2. An assembly as in claim 1 wherein the passage includes a directional change between its ends, the bearing means at said spaced ends being non-coaxial.

3. An assembly as in claim 1 wherein the passage includes at least one branch, each such branch including one of the passage ends provided with said bearing means, said bearing means of each said branch being additionally of at least part-cylindrical form.

4. An assembly as in claim 1 wherein said ball-like ends are part-spherical and said bearing means comprise separate rings.

5. An assembly as in claim 1 wherein said housing is cast around said bearing rings with said shield in place.

6. A low-stress exhaust manifold assembly for an internal combustion engine, said assembly comprising a plurality of housings each defining a passage for the transmission of engine exhaust gases therethrough, each passage having at least two spaced ends opening outwardly of its respective housing, said housings being connectable to form a single housing assembly with a continuous passage therethrough, internal bearing means in each housing at each of said ends, at least one of the bearing means of each housing being of at least part-cylindrical form, and a tubular shield within each passage and extending between its spaced ends, each said shield having ball-like ends, one engaging each of the bearing means to fix the lateral position of the shield within its associated passage, said ball-like shield ends providing slip joints within their associated bearing means to allow freedom for rotational motion and said at least part-cylindrical bearing means each also permitting free axial motion of their associated ball-like ends.

7. An assembly as in claim 6 wherein the passage of at least one of the housings includes at least one branch, each such branch including one of the passage ends provided with said bearing means, said bearing means of each said branch being additionally of at least part-cylindrical form.

8. An assembly as in claim 7 wherein said ball-like ends are part-spherical and said bearing means comprise separate rings, each said housing being cast around its bearing rings with its respective shield in place.

* * * * *